US006675423B2

(12) United States Patent
Egan

(10) Patent No.: US 6,675,423 B2
(45) Date of Patent: Jan. 13, 2004

(54) TWO ROLL TURRET WITH POSITIVE NIP WEB CLEANER

(76) Inventor: Ronald G. Egan, 945 Joylene Dr., Webster, NY (US) 14580

( * ) Notice: Subject to any disclaimer, the term of this patent is extended or adjusted under 35 U.S.C. 154(b) by 302 days.

(21) Appl. No.: 09/891,756

(22) Filed: Jun. 26, 2001

(65) Prior Publication Data

US 2002/0194688 A1 Dec. 26, 2002

(51) Int. Cl.[7] ..... B08B 6/00
(52) U.S. Cl. ..... 15/3; 15/100; 15/102
(58) Field of Search ..... 15/3, 100, 102

(56) References Cited

U.S. PATENT DOCUMENTS 4,982,469 A * 1/1991 Nishiwaki ..... 15/3
5,251,348 A * 10/1993 Corrado et al. ..... 15/256.53
5,423,104 A * 6/1995 West ..... 15/100
5,519,914 A * 5/1996 Egan ..... 15/256.53
5,855,037 A * 1/1999 Wieloch et al. ..... 15/3
6,378,154 B1 * 4/2002 Corrado et al. ..... 15/3
6,523,208 B1 * 2/2003 Muscato et al. ..... 15/3

* cited by examiner

*Primary Examiner*—Theresa T. Snider
(74) *Attorney, Agent, or Firm*—Shlesinger, Fitzsimmons & Shlesinger

(57) ABSTRACT

A web cleaner and cleaner roll system includes a frame having rotatably mounted thereon a web roll for rotation by a web that travels thereover during a web cleaning operation, a turret shaft rotatable in spaced, parallel relation to the web roll, and a pair of web cleaner rolls carried by the turret for rotation in spaced parallel relation to each other and the web roll. The turret shaft is intermittently rotated to move each of the two cleaner rolls between an operative position in which one of the two rolls is in rolling, cleaning engagement with the travelling web and the other is in an inoperative position in which it is spaced from said web. The turret shaft and cleaner rolls are mounted on the frame for limited movement toward and away from the web, and function to force a cleaner roll in its operative position resiliently against the web that is being cleaned. A roll cleaner is mounted on the frame to engage and reciprocate longitudinally of the periphery of a cleaner roll when the latter is moved to and rotated in its inoperative position.

7 Claims, 3 Drawing Sheets

TWO ROLL TURRET WITH POSITIVE NIP WEB CLEANER

BACKGROUND OF THE INVENTION

This invention relates to contact cleaner rolls for cleaning webs employed in paper making, printing apparatus, and the like. More particularly, this invention relates to an improved two cleaner roll turret for web cleaning apparatus which allows the web to be nipped between a cleaner or cleaning roller and an idler roller thereby eliminating any undesirable boundary layer of air which interferes with the attraction of the web to the cleaning roll.

Disclosed in U.S. Pat. No. 5,251,348 is a contact cleaner roll mechanism employing three, spaced, parallel cleaner rolls rotatably mounted on a rotatable turret which, periodically positions the surface of one of the contact rollers into registry with a contact roll cleaner, while maintaining the other two cleaner rolls in engagement with the web that is to be cleaned. Each cleaner roll comprises a steel roll coated with a tacky polymer surface, so that the two engage with the web transfer particles from the web to their tacky surfaces, while the third, inactive roller is cleaned by having such particles removed from its surface by the roll cleaner.

One of the problems encountered with this prior art device is the fact that each of the cleaner rollers is rotatably mounted on the associated turret, while the web, which passes over the two, operative cleaning rollers, is positively driven by web drive motors, so that rotation is imparted to the two active rollers by virtue of their tacky surfaces being engaged with the traveling web. The amount of tension between the cleaning roller surfaces and the web, therefore, is determined by the web speed, and the machine web tension set by operation of the web drive motors. Consequently as the machine speed increases the boundary layer of air between the web and the surfaces of the two cleaning rollers also increases, thereby decreasing the attraction of the web to the respective cleaning rollers. Consequently, with low web tensions, or low wrap angles over the respective cleaning rollers, the cleaning effectiveness of the two operative rollers is reduced.

It is an object of this invention, therefore, to provide for web cleaner apparatus an improved two roll cleaner turret which allows very rapid change of the two cleaner rollers, placing the surface of a new, clean cleaner roller into nipping engagement with the web, and at the same time placing the now-dirty cleaning roller surface into registry with the roller cleaner mechanism.

A further object of this invention is to provide a two cleaner roll turret which is readily adjustable to change the nip pressure between the web and the cleaner roll then in engagement with the web.

Still a further object of this invention is to provide a two cleaner roll turret in which the nip pressure adjustment device functions also as a shock absorber enabling the operative cleaner roll to be moved away from the associated customer roller if a web splice or other thickness anomaly occurs in the customer web during a cleaning operation.

Still other objects of this invention will be apparent hereinafter from the specification and from the recital of the appended claims, particular when read in conjunction with the accompanying drawings.

SUMMARY OF THE INVENTION

A web roll is rotatably mounted on a frame for rotation by a web that travels thereover during a web cleaning operation; and a roll cleaner is mounted on the frame to reciprocate in a path spaced from and parallel to the web roll. A rotatable turret shaft which is mounted on the frame between and in spaced, parallel relation to the web roll and path of travel of the roll cleaner, carries a pair of cleaner rolls for rotation in spaced parallel relation thereto. The turret shaft is intermittently rotated to swing each of the cleaner rolls successively into rolling engagement with the traveling web, and then into engagement with the roll cleaner. The cleaning roll engaged with the web is urged resiliently thereagainst.

THE DRAWINGS

DETAILED DESCRIPTION OF THE PREFERRED EMBODIMENTS

Figure 1:
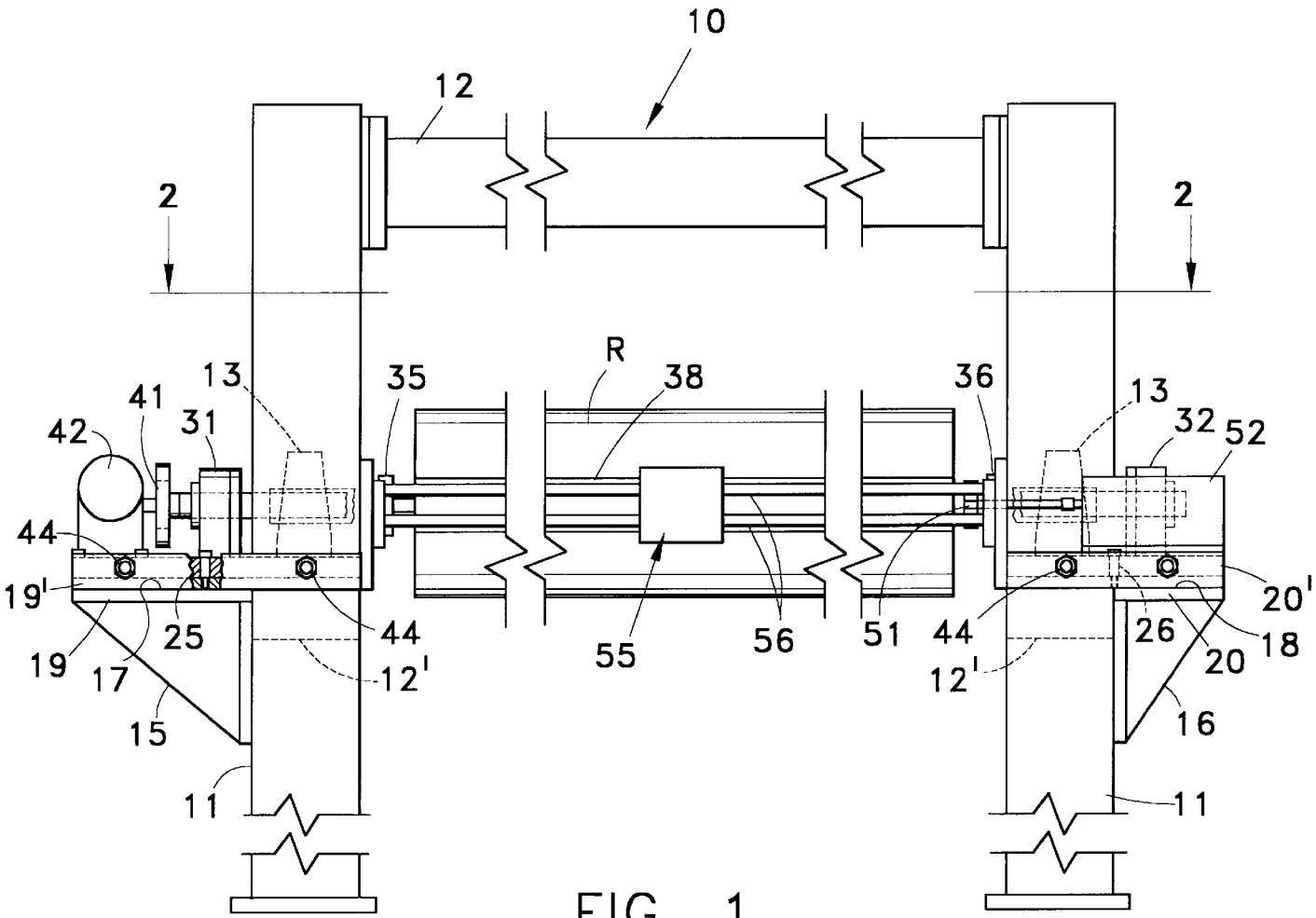
FIG. 1 is a fragmentary front elevational view of web cleaning apparatus including a two roll turret web cleaner mechanism made according to one embodiment of this invention.
Figure 2:
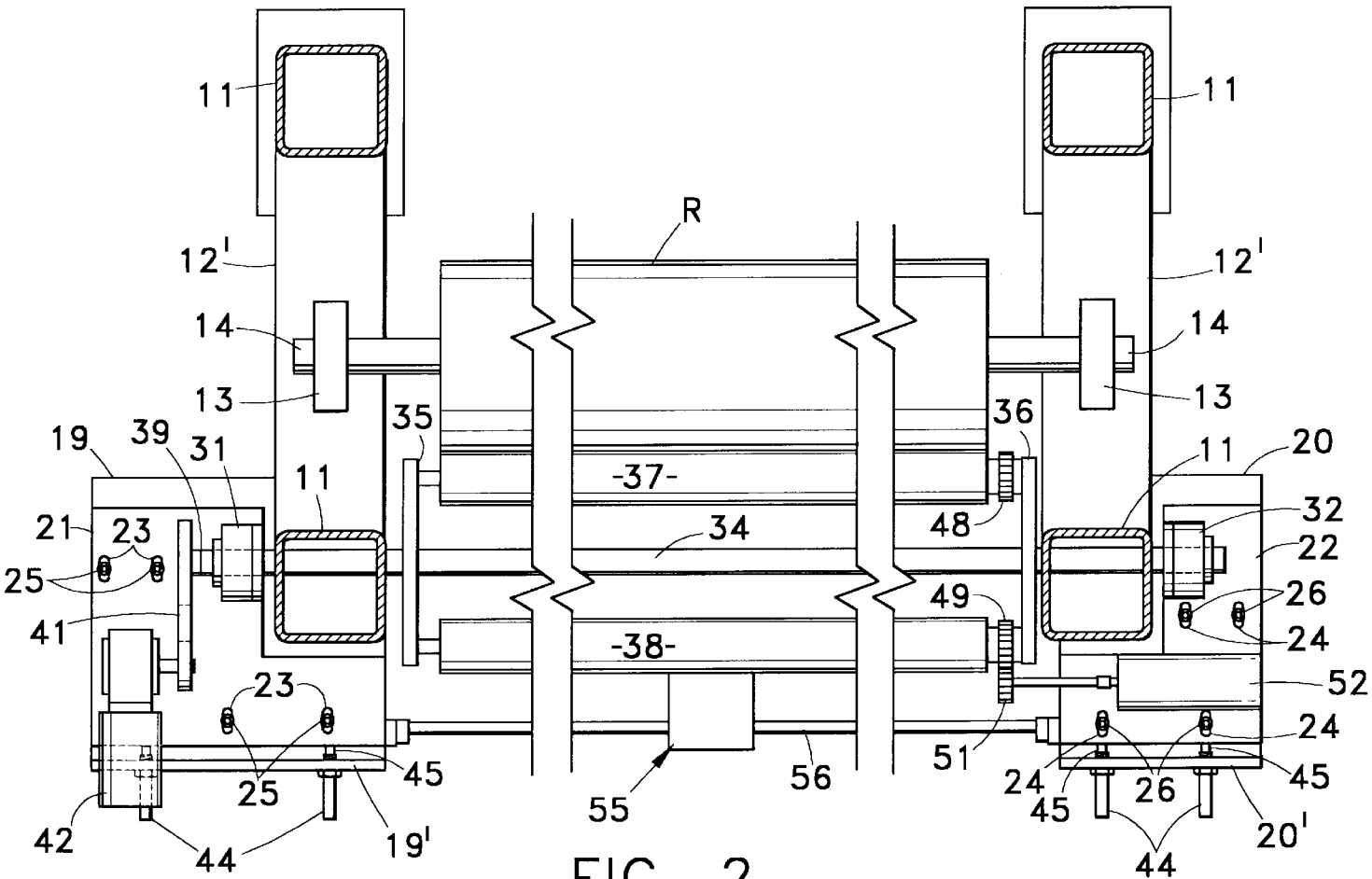
FIG. 2 is a fragmentary sectional view of this apparatus taken generally along the line 2—2 in FIG. 1 looking in the direction of the arrows, and on a slightly smaller scale.

Referring now to the drawings by numerals of reference, 10 denotes generally the frame of a web cleaner mechanism having four rectangularly spaced, vertically disposed columns 11 secured at their upper ends to four horizontally disposed, rectangularly spaced horizontal beams 12. At each end of the frame 10, the right and left hand ends thereof as shown in FIGS. 1 and 2, the two, spaced, vertical columns 11 have the confronting surfaces thereof secured to opposite ends of a rigid, horizontally disposed roller supporting plate 12', each of plates 12' having the upper surfaces thereof disposed in a common, horizontal plane. Secured to the upper surface of each of the plates 12', medially thereof, is a housing 13 containing a conventional roller bearing (not illustrated). Secured in the bearings in the housings 13 to be rotatably supported thereby are the reduced-diameter, opposite ends 14 of the shaft of a conventional web roller R, which in use is adapted to be rotated by a web W which travels thereover during a cleaning operation, as noted hereinafter.

Intermediate their ends the two front columns 11 of frame 10 (the lowermost in FIG. 2) have secured to the surfaces remote from each other brackets 15 and 16 (FIG. 1) having plane, horizontally disposed, coplanar upper surfaces 17 and 18, respectively, which extend at right angles outwardly from the surface to which the respective brackets 15 and 16 are secured. Secured to the upper surfaces 17 and 18 of the brackets 15 and 16 are right angularly shaped, horizontally disposed plates 19 and 20, respectively. One edge of plate 19, which extends parallel to and is spaced from the front or lower surface of the associated column 11 as shown in FIG. 2, has formed thereon an integral flange 19' which extends longitudinally of the associated edge of the plate 19, and which projects slightly above the upper surface of plate 19. Likewise plate 20 has integral with an edge thereof which is spaced from and parallel to the front surface of its associated vertical column 11 to longitudinally extending flange 20" which projects at right angles and slightly above the upper surface of plate 20.

Mounted for limited sliding movement on the plates 19 and 20 are slightly smaller, but similarly shaped rectangular plates 21 and 22, respectively. Each of plates 21 and 22 have therethrough four spaced, parallel slots 23 and 24, respectively, and are guided for limited sliding movement at right angles to, and toward and away from the axis of the roller R by the shanks of bolts 25 and 26, respectively. These bolts are secured at their lower ends to plates 19 and 20, respectively, and project upwardly and slidably through the slots 23 and 24. The heads of bolts 25 and 26 slidably overlie the upper surface of plates 21 and 22.

Secured to the upper surfaces of adjustable plates 21 and 22 in spaced, confronting relation to the adjacent columns 11 are two bearing housings 31 and 32, respectively, each of which has therethrough an opening that registers with a like opening in the adjacent front column 11. Extending adjacent opposite ends thereof through the registering openings in the front columns 11 and the adjacent bearing housings 31 and 32 is an elongate turret shaft 34, opposite ends of which are rotatably journaled in the housings 31 and 32 for rotation in spaced, parallel relation to the web roller R. Secured intermediate their ends to shaft 34 adjacent opposite ends thereof, and for rotation by shaft 34 adjacent the inner edges of the plates 12' are two, rigid, roller supporting arms 35 and 36. Extending between the arms 35 and 36, and rotatably journaled at opposite ends thereof in the ends of the arms 35 and 36 adjacent to the web roller R as shown in FIG. 2 is an elongate web cleaner roll 37. Extending between and rotatably journaled at opposite ends thereof in the opposite ends of the arms 35 and 36 is a second cleaner roll 38 that extends parallel to roll 37, and the axis of which is coplanar with the axis of roll 37. As noted in greater detail hereinafter, the shaft 34 is disposed to rotate the arms 35 and 36 selectively to place the tacky surface of one or the other of the cleaner rolls 37 and 38 into operative engagement with a web W (FIG. 3) which is fed as noted hereinafter over the web roller R.

Figure 3:
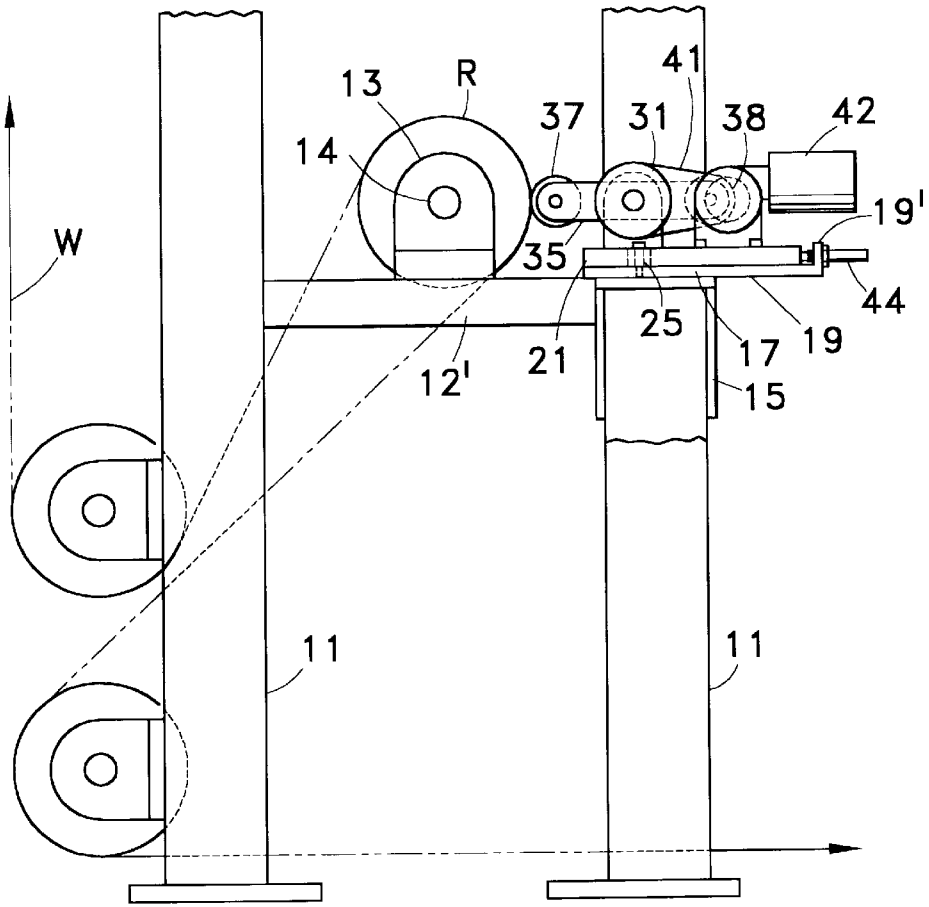
FIG. 3 is a view of the apparatus as seen when looking at the left hand of the mechanism as shown in FIG. 2, and with the web which is to be cleaned, and supporting rolls therefor being shown in phantom by broken lines.

To effect rotation of the shaft 34, one end thereof (the left end as shown in FIG. 2) extends beyond the housing 31 and has secured thereon a toothed disc or gear 39, which is connected by drive belt 41 to the output of an electric motor 42 which is secured on plate 21 for limited movement therewith. As noted hereinafter, motor 42 is periodically operated to swing one of the cleaning rollers 37 and 38 (37 in the embodiment illustrated) into engagement with the web W which, as shown in FIG. 3, passes around the web roller R and effects rotation thereof, as the web passes through the apparatus in the direction of the broken line and arrow shown in FIG. 3. When the cleaning roll 37 engages the web against roller R as shown in FIGS. 2 and 3, the other cleaning roller 38 is swung by shaft 34 and its members 35 and 36 into a position remote from the web roller R where it is to be cleaned by an automatic roll cleaner mechanism as noted hereinafter.

As previously noted, the bearing housings 31 and 32 supporting the turret shaft 34 are mounted for limited adjustment toward and away from the web roller R. In order to retain one of the cleaner rollers 37 or 38 with a reasonable force against the web W that is being cleaned, each of the flange sections 19' and 20' on the stationary plates 19 and 20 have mounted therein intermediate their respective ends a pair of spaced, tubular plunger housings 44. Each housing 44 contains an adjustable spring-loaded plunger 45, one end of which extends slidably out of the associated housing 44 in the direction of the web roller R. As shown in FIG. 2, the housings 44 are positioned in such a manner that outer ends of their spring loaded plungers 45 engage the edge of movable plate 21 remote from the roller R, while the plungers 45 of housings 44 on flange 20' engage the edge of the movable plate 22 remote from the roller R. In this manner the spring-loaded plungers 45 resiliently urge the plates 21 and 22 toward the web roller R, in turn urging turret shaft 34 toward roll R, so that the surface of the particular cleaner roll 37 or 38 which happens to be in engagement with the web W will be resiliently urged against the web with a nip force generated by the springs in the housings 44. It will be apparent to one skilled in the art, that, if desired, rather than employing springs in the housings 44, these housings could be connected to pneumatic means for resiliently maintaining one of the cleaner rolls 37 or 38 in engagement with the web W.

As shown more clearly in FIG. 2 the reduced-diameter ends of the cleaner rolls 37 and 38 adjacent to the side of the support arm 36 remote from the adjacent plate 12 have secured thereon spur gears 48 and 49, respectively. Whenever one of the rollers 37 or 38 is swung by motor 42 from engagement with a web W to its position remote from the web, as shown for example by roll 38 in FIG. 2, the spur gear 48 or 49 of the respective roller is placed into engagement with a gear 51 which is secured to the output shaft of a roll cleaner motor 52, which is mounted in a fixed position on the plate 22. Moreover, when a respective roller 37 or 38 is swung into the position in which it is to be rotated by the drive gear 51, the peripheral surface of the roller, such as that of roller 38 as shown in FIG. 2, is placed in registry with the frame of a contact type automatic roll cleaner, which is denoted generally by the numeral 55, and which corresponds to the roll cleaner disclosed in my U.S. Pat. No. 5,519,914, the contents of which is incorporated herein. The contact roll cleaner 55 is mounted for movement pneumatically on rods 56 which are secured to and extend between opposite ends of the frame 10 to guide the cleaner 55 longitudinally of the roll 37 or 38 the surface of which is being cleaned, and which roll at such time is being rotated (counterclockwise in FIG. 3) by motor 52.

From the foregoing it will be apparent that the present invention provides a relatively simple but very accurate means for selectively engaging one of two different cleaning rolls with a web that is to be cleaned, but at the same time maintaining a predetermined nip force of the cleaning roller against the web. The motor 52 and its drive gear 51 rotate either the roll 37 or 38, whichever is being cleaned by roll cleaner 55, in the direction in which the web W travels. As motor 32 begins to rotate the turret shaft 34 after roll 37 or 38 has been cleaned, motor 52 continues to rotate briefly, allowing the cleaned roller to free spin, so that when reengaged with the web W a now-cleaned roller 37 or 38 may still be rotating slightly in the correct direction as it engages the web. Moreover, the advantage of using spring-loaded means for maintaining the force exerted by roll 37 or 38 against the web is the fact that the spring-loaded mechanism functions as a shock absorber to allow the turret assembly carried by plates 21 and 22 to move away from the web roller if a web splice or other unexpected thickness anomaly occurs during the web cleaning operation. Also, the spring-loaded plungers employed in the housings 44 are the type which can be readily adjusted to alter the force between the cleaning roller and the web. Also, as noted above, while the plungers of the housing 44 have been denoted as being spring loaded, it will be apparent to one skilled in the art that the plungers in the housings 44 could be pneumatically controlled, if desired, rather than employing springs.

While this invention has been illustrated and described herein in connection with only certain embodiments thereof, it will be apparent to one skilled in the art that it is capable of still further modification, and that this application is intended to cover any such modifications as may fall within the scope of one skilled in the art, or the appended claims.

What is claimed is:

1. A combined web cleaner and cleaner roll system, comprising, a frame having a web roll rotatably mounted thereon for rotation by a web that travels thereover during a web cleaning operation, cleaner roll supporting means supporting a pair of cleaner rolls on said frame for rotation in spaced parallel relation to each other and said web roll, and with the axes of said cleaner rolls disposed in a common plane, means operable intermittently to move each of said cleaner rolls between an operative position in which one of the two cleaner rolls is in rolling, cleaning engagement with the web traveling over said web roll, and the other of the cleaner rolls is in an inoperative position in which said other roll is spaced from said web, said cleaner roll supporting means mounted on said frame for limited movement in said common plane toward and away from said web roll, and operative to force one of the cleaner rolls in its operative position resiliently against the web that is being cleaned, and means for adjusting said force exerted by the cleaner roll against said web.

2. The combined system as defined in claim 1, including a roll cleaner device mounted on said frame for engagement with and to travel longitudinally of the peripheral surface of the cleaner roll disposed in its inoperative position, and cleaner roll drive means operative when the cleaner roll is in its inoperative position positively to effect rotation thereof as said cleaner device travels axially thereof.

3. The combined system as defined in claim 1, wherein said cleaner roll supporting means comprises a pair of spaced, parallel plates mounted on said frame in spaced relation to said web roll, and for limited movement in a plane parallel to said common plane toward and away from said web roll, a turret shaft rotatably supported adjacent opposite ends thereof on said plates in spaced, parallel relation to said web roll, means supporting said cleaner rolls on said turret shaft in spaced, parallel confronting relation to diametrally opposite sides thereof, and a motor mounted on one of said plates and drivingly connected to said turret shaft to effect movement of said cleaner rolls into and out of their operative and inoperative positions, respectively.

4. The combined system as defined in claim 1, wherein said cleaner roll drive means comprises, a gear secured to each of said cleaner rolls adjacent one end thereof, a rotatable drive gear mounted on said frame for operative engagement by the gear on the cleaner roll disposed in its inoperative position, and a motor connected to said drive gear for effecting rotation thereof when the cleaner roll is in its inoperative position.

5. A combined web cleaner and cleaner roll system, comprising a frame having a web roll rotatably mounted thereon for rotation by a web that travels thereover during a web cleaning operation, a roll cleaner mounted on said frame for reciprocable travel in a path spaced from and extending parallel to said web roll, a rotatable turret shaft mounted on said frame between and in spaced parallel relation to said web roll and the path of travel of said roll cleaner, and for limited movement toward and away from said web roll, means rotatably mounting a pair of cleaner rolls on said turret shaft for rotation in spaced parallel relation thereto, and means for intermittently rotating said turret shaft to swing each of the cleaner rolls successively to a first position in rolling engagement with said traveling web, and then to a second position in engagement with said roll cleaner means resiliently urging said turret shaft toward a limit position in the direction of said web roll.

6. The combined system as defined in claim 5, wherein the axes of said web roll, said turret shaft and said cleaner rolls are disposed in a common plane.

7. The combined system as defined in claim 5, including means positively rotating each of said cleaner rolls when in said second position thereof.

* * * * *